US010828794B2

(12) United States Patent
Okabe et al.

(10) Patent No.: US 10,828,794 B2
(45) Date of Patent: Nov. 10, 2020

(54) AUTOMATIC SIZING CUTTING DEVICE

(71) Applicant: YKK Corporation, Tokyo (JP)

(72) Inventors: Katsuro Okabe, Kurobe (JP); Kazuya Takase, Kurobe (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 16/092,486

(22) PCT Filed: Apr. 12, 2016

(86) PCT No.: PCT/JP2016/061836
§ 371 (c)(1),
(2) Date: Oct. 10, 2018

(87) PCT Pub. No.: WO2017/179132
PCT Pub. Date: Oct. 19, 2017

(65) Prior Publication Data

US 2019/0160701 A1 May 30, 2019

(51) Int. Cl.
*B26D 5/08* (2006.01)
*B26D 5/00* (2006.01)
(Continued)

(52) U.S. Cl.
CPC ..... *B26D 5/086* (2013.01); *B26D 1/36* (2013.01); *B26D 5/00* (2013.01); *B26D 5/20* (2013.01);
(Continued)

(58) Field of Classification Search
CPC ..... B26D 5/08; B26D 5/083; B26D 5/086; B26D 5/20; B26D 5/22; B26D 5/26; B26D 5/28; B26D 5/30; B26D 5/36; B26D 5/365
See application file for complete search history.

(56) References Cited

U.S. PATENT DOCUMENTS 1,909,027 A * 5/1933 Clair Valentine ..... A61F 13/00991 28/170
3,952,637 A * 4/1976 Lambert ..... B26D 3/12 493/30
(Continued)

FOREIGN PATENT DOCUMENTS

CN 1401302 A 3/2003
CN 14013022 A 3/2003
(Continued)

OTHER PUBLICATIONS

International Search Report, PCT Patent Application No. PCT/JP2016/061836, dated Jul. 19, 2016.
(Continued)

*Primary Examiner* — Andrea L Wellington
*Assistant Examiner* — Richard D Crosby, Jr.
(74) *Attorney, Agent, or Firm* — Kilpatrick Townsend & Stockton LLP

(57) ABSTRACT

An automatic sizing cutting device includes a conveyance unit, a measuring device, a rotary cutter arranged downstream of the conveyance unit so as to oppose a band-shaped member and having a cutting blade on an outer circumferential surface thereof, a die roller which is arranged on a side of the band-shaped member opposite to the rotary cutter and which rotates in a direction opposite to a rotation direction of the rotary cutter; and an elastic member which urges the die roller toward the rotary cutter. The rotary cutter is controlled to rotate in accordance with a conveyed length of the band-shaped member measured by the measuring device, and is controlled such that circumferential speeds of the rotary cutter and the die roller when the cutting blade of the rotary cutter cuts the band-shaped member are equal to a conveying speed of the band-shaped member.

5 Claims, 8 Drawing Sheets

(51) Int. Cl.

| | |
|---|---|
| ***B26D 1/36*** | (2006.01) |
| ***B26D 5/20*** | (2006.01) |
| ***B26D 7/20*** | (2006.01) |
| ***B26D 7/28*** | (2006.01) |

(52) U.S. Cl.
CPC ..... *B26D 7/20* (2013.01); *B26D 7/28* (2013.01); *B26D 2007/202* (2013.01)

(56) References Cited

U.S. PATENT DOCUMENTS

| | | | | | |
|---|---|---|---|---|---|
| 4,207,044 | A * | 6/1980 | Lionello | A21C 15/04 | 425/126.1 |
| 4,476,754 | A * | 10/1984 | Ducret | B23D 47/042 | 83/150 |
| 4,685,318 | A * | 8/1987 | Ueda | B21D 13/04 | 72/185 |
| 4,933,224 | A * | 6/1990 | Hatch | A44B 18/0076 | 24/306 |
| 5,088,368 | A | 2/1992 | Marion | | |
| 5,158,640 | A * | 10/1992 | Akiyama | G11B 23/00 | 156/542 |
| 5,614,057 | A * | 3/1997 | Conley, Jr. | A44B 18/0073 | 156/354 |
| 5,765,460 | A * | 6/1998 | Wathieu | B23D 36/005 | 83/311 |
| 6,066,833 | A * | 5/2000 | Rigdon | B23K 9/133 | 219/137.2 |
| 6,389,942 | B1 * | 5/2002 | Matsumoto | B21F 11/00 | 83/175 |
| 7,107,891 | B2 * | 9/2006 | Kneppe | B23D 25/12 | 83/663 |
| 7,493,676 | B2 * | 2/2009 | Murasaki | A44B 18/0061 | 24/442 |
| 8,176,821 | B2 * | 5/2012 | Taillardat | B26D 7/20 | 83/331 |
| 9,993,932 | B2 * | 6/2018 | Salamone | B26D 1/405 | |
| 2002/0152860 | A1 * | 10/2002 | Machamer | B26D 7/20 | 83/37 |
| 2002/0170399 | A1 * | 11/2002 | Gass | B23D 59/001 | 83/62.1 |
| 2003/0047273 | A1 * | 3/2003 | Kojo | A61F 13/15609 | 156/250 |
| 2004/0089402 | A1 * | 5/2004 | Cyr | B65H 19/102 | 156/157 |
| 2010/0176538 | A1 * | 7/2010 | Nozawa | A44B 18/0076 | 264/402 |
| 2012/0114782 | A1 * | 5/2012 | Sho | B29C 31/008 | 425/510 |
| 2012/0234145 | A1 * | 9/2012 | Kandemir | B26D 7/204 | 83/56 |
| 2013/0205964 | A1 * | 8/2013 | Matsushita | B65C 3/065 | 83/80 |
| 2014/0318340 | A1 * | 10/2014 | Mochizuki | B26D 5/32 | 83/346 |
| 2016/0008998 | A1 * | 1/2016 | Denisse | B26D 7/1818 | 493/471 |
| 2016/0016324 | A1 * | 1/2016 | Bapst | B26D 7/26 | 493/471 |
| 2016/0039119 | A1 * | 2/2016 | Sho | B29C 31/008 | 83/23 |
| 2019/0160701 | A1 * | 5/2019 | Okabe | B26D 5/00 | |

FOREIGN PATENT DOCUMENTS

| | | | |
|---|---|---|---|
| CN | 203972709 | U | 12/2014 |
| EP | 0371891 | A1 | 6/1990 |
| JP | H10-094995 | A | 4/1998 |
| JP | H10-329094 | A | 12/1998 |
| JP | 3067223 | U | 12/1999 |
| JP | 2002-205295 | A | 7/2002 |
| JP | 2005-268002 | A | 9/2005 |
| JP | 2007-130707 | A | 5/2007 |
| JP | 2009-000792 | A | 1/2009 |
| JP | 2011-189573 | A | 9/2011 |
| KR | 2010-0043704 | A | 4/2010 |
| KR | 101334683 | B1 | 12/2013 |
| WO | 2012-061542 | A1 | 5/2012 |

OTHER PUBLICATIONS

Written Opinion, PCT Patent Application No. PCT/JP2016/061836, dated Jul. 19, 2016.

International Preliminary Report on Patentability, PCT Patent Application No. PCT/JP2016/061836, dated Oct. 25, 2018.

European Extended Search Report, European Patent Application No. 16898592.7, dated Mar. 18, 2020.

Office Action, Chinese Patent Application No. 201680084526.X, dated Dec. 6, 2019, 10 pages.

Office Action, Korean Patent Application No. 10-2018-7028982, dated Dec. 23, 2019, 11 pages.

Office Action, Chinese Patent Application No. 201680084526.X, dated Jul. 29, 2020, 16 pages.

* cited by examiner

AUTOMATIC SIZING CUTTING DEVICE

TECHNICAL FIELD

The present invention relates to an automatic sizing cutting device, and more particularly to an automatic sizing cutting device suitable for cutting an elongated hook fastener tape at a predetermined length to obtain a hook fastener strip.

BACKGROUND ART

For vehicle seats, a seat cover is conventionally fixed on a foam bun by engaging a hook fastener strip, which is provided on the foam bun, with a loop material, which is provided on the seat cover. In general, the foam bun for vehicle seats is formed by positioning a hook fastener strip having a predetermined length in a trench of a mold, injecting a foaming solution, such as polyurethane, into the mold and then foaming the foaming solution within the mold. A plurality of hook fastener strips having different lengths is often required for the foam bun.

In Patent Document 1, a system and a method are disclosed, in which a hook fastener tape straightened by applying heat thereto using an accumulation chamber is conveyed to a cutting unit, the cutting unit cuts the hook fastener tape at a predetermined length to form hook fastener strips, and then the hook fastener strips are supplied to a plurality of molds moving on an assembly line. Also, in the cutting unit, the hook fastener tape is conveyed by rotating rollers using a supply motor, a conveyed length of the hook fastener tape is measured by an encoder, and then the hook fastener tape is cut at a predetermined length by a rotary cutter, thereby forming hook fastener strips.

Further, as other cutting devices for cutting an elongated object, those as disclosed in Patent Documents 2 and 3 are known. Patent Document 2 discloses a length measuring device for measuring a length of an electric wire upon cutting thereof, which includes a pair of electric wire feeding rollers arranged on upstream and downstream sides along a conveying path to be spaced from each other and configured to be rotationally driven while sandwiching the electric wire therebetween, and a length measuring roller having an encoder for measuring an conveyed length of the electric wire and arranged between the pair of electric wire feeding rollers, thereby more reliably preventing the electric wire from being fed due to inertia of the length measuring roller. Also, Patent Document 3 discloses a corner cutting device for cutting a corner of a dried layer packaging film for a rice ball, which includes a segment cutter having a cutting edge and used in a rotating state, and a cutter supporting bearing positioned just below the segment cutter and configured to rotate together with the cutting edge while being always repressively in contact therewith due to a pushing-up urging force exerted thereon by a compressive coil spring.

CITATION LIST

Patent Document

Patent Document 1: WO 2012/061542

Patent Document 2: Japanese Patent Application Publication No. 2005-268002

Patent Document 3: Japanese Utility Model Registration Publication No. 3067223

SUMMARY OF INVENTION

Problems to be Solved

Recently, an automated line for manufacturing a foam bun is being speeded up in order to improve work efficiency. Accordingly, also for the cutting unit, it is necessary to speed up conveyance of the hook fastener tape so that the hook fastener strips can be rapidly supplied to the automated line.

In the cutting unit described in Patent Document 1, cutting is performed in a fixed die manner. Accordingly, disturbance is added to operation of a cutting shaft due to a friction between a work piece and a die, thereby causing variations in cut dimensional precision or surface precision of a cut surface. Further, even when an encoder shaft controlling the cutting shaft is influenced by vibration upstream thereof and hence disturbance is added to operation of the cutting shaft, variations in cut dimensional precision will occur. Such variations become more noticeable when attempting to speed up conveyance of the hook fastener tape, and thus there is a need for further improvement.

Also, in the electric wire length measuring device described in Patent Document 2, a technique for preventing the electric wire from being fed due to inertia of the length measuring roller is provided. However, the pair of electric wire feeding rollers is driven using one motor, a transmission belt and gears and is configured to stop conveying the electric wire whenever the electric wire is cut. Accordingly, the pair of electric wire feeding rollers is not configured to perform a high speed conveyance.

Further, in the corner cutting device described in Patent Document 3, the segment cutter and the cutter supporting bearing are configured to rotate together due to an urging force of the compressive coil spring. Accordingly, there is a possibility that a rotational shift may occur between both.

The present invention has been made keeping in mind the above problems, and an object thereof is to provide an automatic sizing cutting device, in which it is possible to cut a continuously conveyed and elongated band-shaped member with a good dimensional precision and at high speed.

Means for Solving the Problems

The object of the present invention is achieved by the following configurations.

An automatic sizing cutting device for cutting a continuously supplied band-shaped member at a predetermined length to obtain a band-shaped piece, includes a conveyance unit which conveys the band-shaped member; a measuring device which measures a conveyed length of the band-shaped member conveyed by the conveyance unit a rotary cutter arranged downstream of the conveyance unit so as to oppose one surface of the band-shaped member and having at least one cutting blade on an outer circumferential surface thereof, the rotary cutter being rotationally driven by a driving motor; a die roller arranged on a side of the band-shaped member opposite to the rotary cutter, and which rotates in a direction opposite to a rotation direction of the rotary cutter; and an elastic member which urges the die roller toward the rotary cutter. The rotary cutter is controlled to rotate in accordance with the conveyed length of the band-shaped member measured by the measuring device, and is controlled such that circumferential speeds of the rotary cutter and the die roller at least when the cutting blade of the rotary cutter cuts the band-shaped member are equal to a conveying speed of the band-shaped member.

The rotary cutter and the die roller may be driven by one driving motor to be rotated at the same circumferential speed but in directions opposite to each other.

The automatic sizing cutting device may further include a support member rotatably supporting the die roller, the support member configured to swing about a swing shaft and configured to be urged by the elastic member so as to swing about the swing shaft; and a gear mechanism arranged between a rotation shaft of the die roller and the swing shaft, where the swing shaft is rotated by the driving motor, the die roller is rotated as rotation of the swing shaft is transferred thereto via the gear mechanism, and the die roller is urged toward the rotary cutter as the elastic member urges the support member.

The driving motor may be connected to a cutter shaft of the rotary cutter, and a power of the driving motor may be transferred to the swing shaft via a timing belt spanned over pulleys respectively fixed on the cutter shaft and the swing shaft.

The conveyance unit may include a pair of feed rollers driven by a pair of motors respectively, and a pair of follower rollers arranged to oppose the pair of feed rollers respectively, and which conveys the band-shaped member while sandwiching the band-shaped member between the feed rollers and the follower rollers, the measuring device may be arranged between the pair of feed rollers, and rotation speeds of the pair of feed rollers are set such that a rotation speed of the feed roller arranged on a downstream side is faster than a rotation speed of the feed roller arranged on an upstream side, so as to convey the band-shaped member while applying a tension to the band-shaped member.

The band-shaped member may be a hook fastener tape.

Advantageous Effects of Invention

According to the present invention, the automatic sizing cutting device includes the conveyance unit for conveying the band-shaped member; the measuring device for measuring a conveyed length of the band-shaped member; the rotary cutter having the cutting blade on an outer circumferential surface thereof and arranged downstream of the conveyance unit and rotationally driven by the driving motor; the die roller arranged to oppose the rotary cutter and configured to rotate in a direction opposite to a rotation direction of the rotary cutter; and the elastic member for urging the die roller toward the rotary cutter. At least when the band-shaped member is cut by the cutting blade of the rotary cutter, the band-shaped member is cut in a state where the rotary cutter and the die roller rotate at a circumferential speed equal to a conveying speed of the band-shaped member. Therefore, it is possible to continually cut the band-shaped member, which is being conveyed at a high speed, with a high dimensional precision, in which variations in cut length thereof is small. Further, it is possible to obtain a good surface precision in the cut surface.

DETAILED DESCRIPTION OF PREFERRED EMBODIMENTS

Hereinafter, embodiments of an automatic sizing cutting device according to the present invention will be described in detail with reference to the accompanying drawings.

Figure 1:
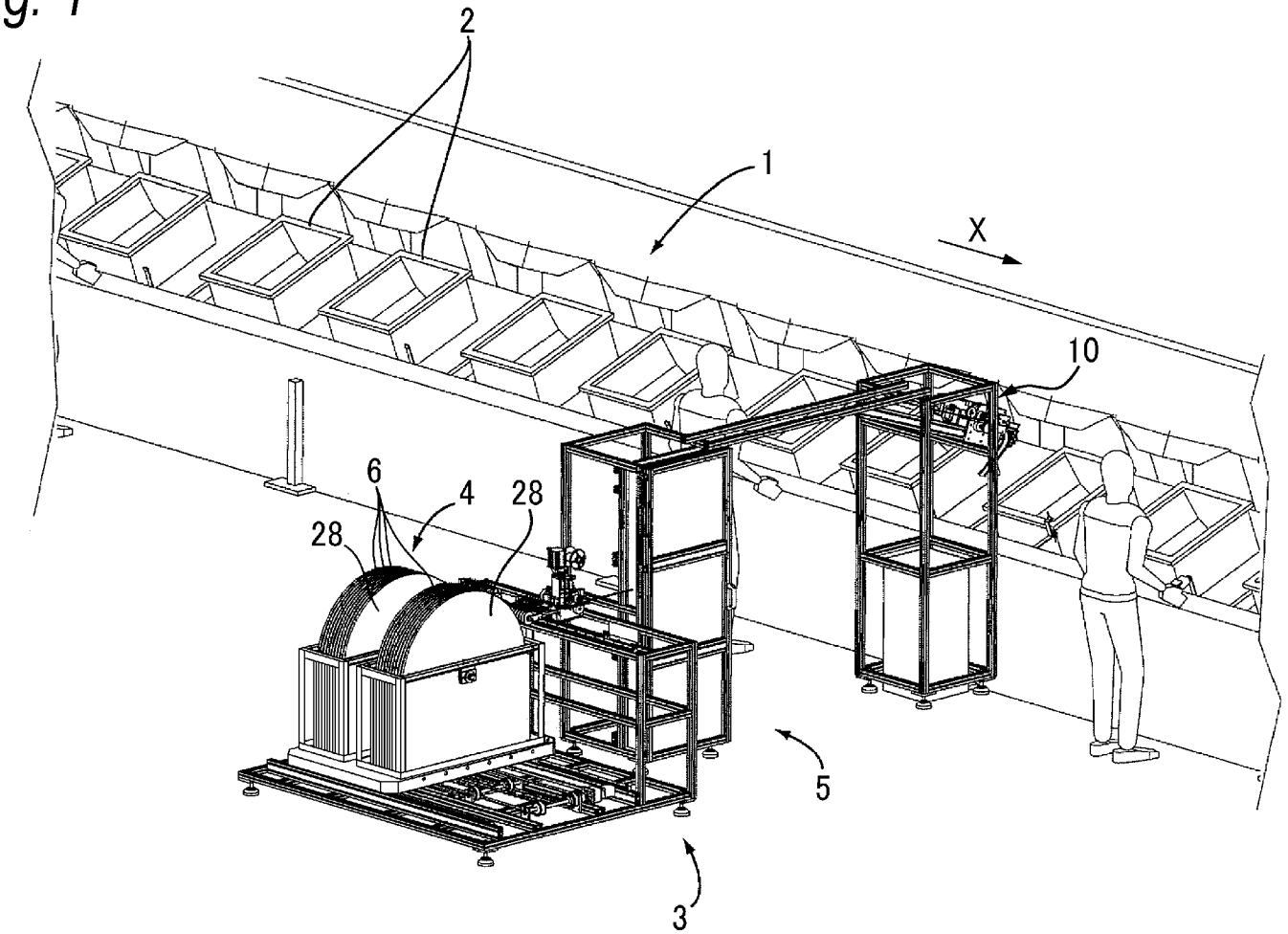
FIG. 1 is a perspective view of a mold assembly line, to which an automatic sizing cutting device according to the present invention is applied.

As shown in FIG. 1, a mold assembly line 1, to which the automatic sizing cutting device of the present invention is applied, has a feeder assembly 3 for feeding the desired number of hook fastener strips (band-shaped pieces) FS having a proper length to a mold 2, which is moving on the mold assembly line 1 in an X direction. The feeder assembly 3 essentially includes a spool exchange unit 4, an accumulation unit 5 and the automatic sizing cutting device 10.

Figure 8:
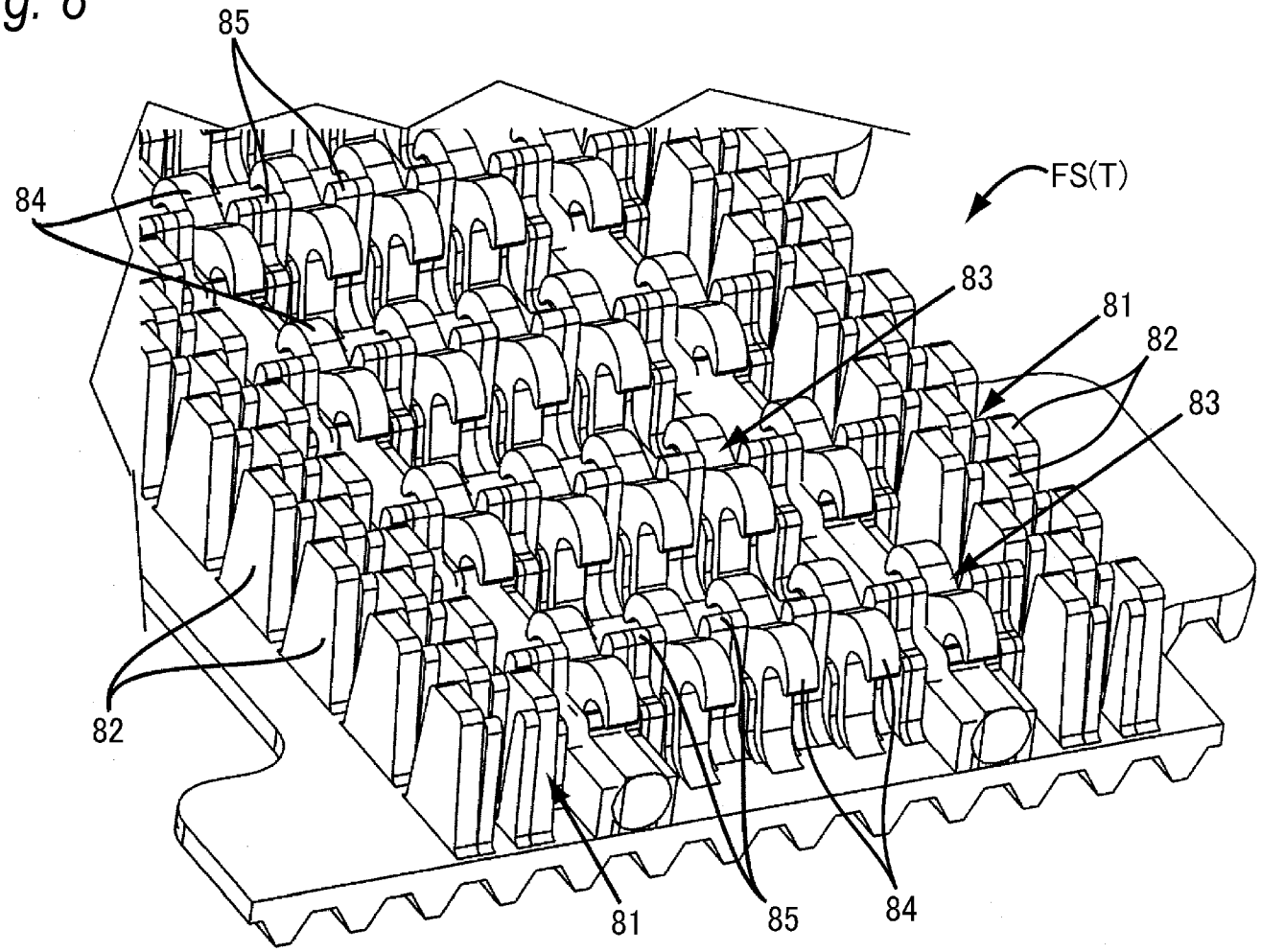
FIG. 8 is a perspective view showing a main part of a hook fastener strip.

As shown in FIG. 8, hook fastener strips FS and a hook fastener tape (band-shaped member) T before the hook fastener strips FS are cut therefrom have a plurality of longitudinal walls 81 extending in a longitudinal direction thereof and a plurality of transversal walls 83 extending in a transversal direction thereof. Each of the longitudinal walls 81 is constituted of a plurality of walls 82 formed in the longitudinal direction of the hook fastener tape T. Each of the transversal walls 83 is constituted of a plurality of hooks 84 and fingers 85 alternately formed. The hooks 84 are configured to be engaged with a loop material provided on a seat cover (not shown), and thus a touch fastener is constructed by the hook fastener strip FS and the loop material. The transversal walls 83 are provided between each pair of longitudinal walls 81 and are plurally arranged at intervals along the longitudinal direction of the hook fastener tape T. The longitudinal walls 81 and the transversal walls 83 are arranged to prevent foam, such as foaming polyurethane, from flowing in between hooks 84 regardless of cut position of the hook fastener tape T, when the foam is injected into a mold upon manufacturing of a foam bun for a vehicle seat.

Turning to FIG. 1, the spool exchange unit 4 is configured to store therein a plurality of reels 6 formed by winding an elongated hook fastener tape Tin a coil shape and also to draw the hook fastener tape T from the reels 6 by a motor (not shown) to supply the hook fastener tape T to the accumulation unit 5. If the hook fastener tape T of one reel 6 is consumed, the spool exchange unit 4 can automatically exchange the one reel 6 for another reel 6 in order to continuously supply the hook fastener tape T. Meanwhile, upon exchanging of the reels 6, a connection device (not shown) connects a terminal end of the hook fastener tape T of the one reel 6 to a starting end of the hook fastener tape T of the another reel 6 with staples or the like.

Figure 2:
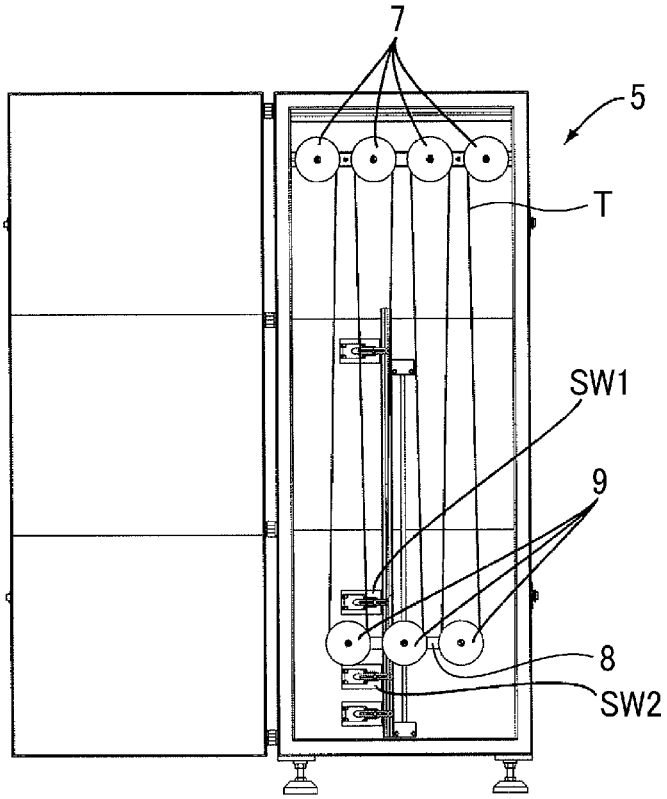
FIG. 2 is a side view of an accumulation unit shown in FIG. 1.

As shown in FIG. 2, the accumulation unit 5 has a plurality of stationary pulleys 7 (four pulleys in FIG. 2) arranged in an upper portion of the accumulation unit 5 and a plurality of movable pulleys 9 (three pulleys in FIG. 2) arranged on a movable base 8, which is vertically movable. Accordingly, the accumulation unit 5 is configured to accumulate the hook fastener tape T therein by winding the hook fastener tape T over the stationary pulleys 7 and the movable pulleys 9 in a zigzag fashion. Also, the accumulation unit 5 has an upper switch SW1 and a lower switch SW2 so as to detect a position of the movable base 8, so that a length of the hook fastener tape T accumulated in the accumulation unit 5 can be maintained within a predetermined range.

That is, if the hook fastener tape T is supplied from the accumulation unit 5 to the automatic sizing cutting device 10, the length of the accumulated hook fastener tape T is decreased and thus the movable base 8 is raised correspondingly. Then, if the upper switch SW1 detects the movable base 8, the motor (not shown) of the spool exchange unit 4 rotates to supply the hook fastener tape T to the accumulation unit 5.

Also, if the hook fastener tape T is supplied from the spool exchange unit 4 to the accumulation unit 5, the length of the accumulated hook fastener tape T is increased and thus the movable base 8 is lowered. Then, if the lower switch SW2 detects the movable base 8, rotation of the motor is stopped and thus supplying of the hook fastener tape T is stopped. In this way, the length of the hook fastener tape T accumulated in the accumulation unit 5 can be maintained with the predetermined range.

Further, since the accumulation unit 5 accumulates the hook fastener tape T in a wound state over the stationary pulleys 7 and the movable pulleys 9, the accumulation unit 5 can correct a curvature of the hook fastener tape T, which is obtained when wound around the reel 6, to a linear shape, thereby facilitating processing in the subsequent processes. The accumulation unit 5 may have a heating unit (not shown) so as to apply heat to the hook fastener tape T accumulated therein, thereby enhancing flexibility of the hook fastener tape T.

Figure 3:
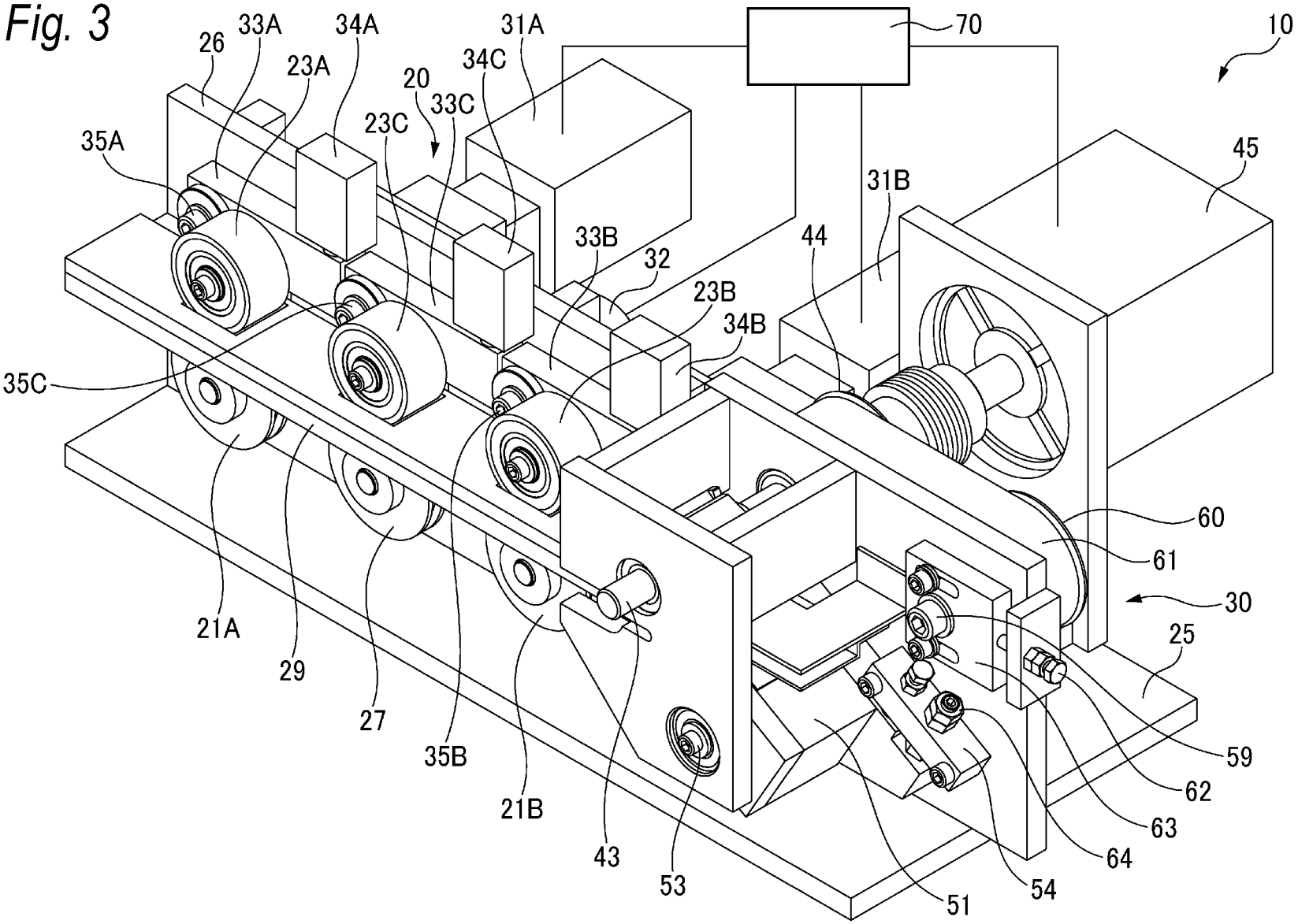
FIG. 3 is a perspective view of the automatic sizing cutting device shown in FIG. 1.
Figure 4:
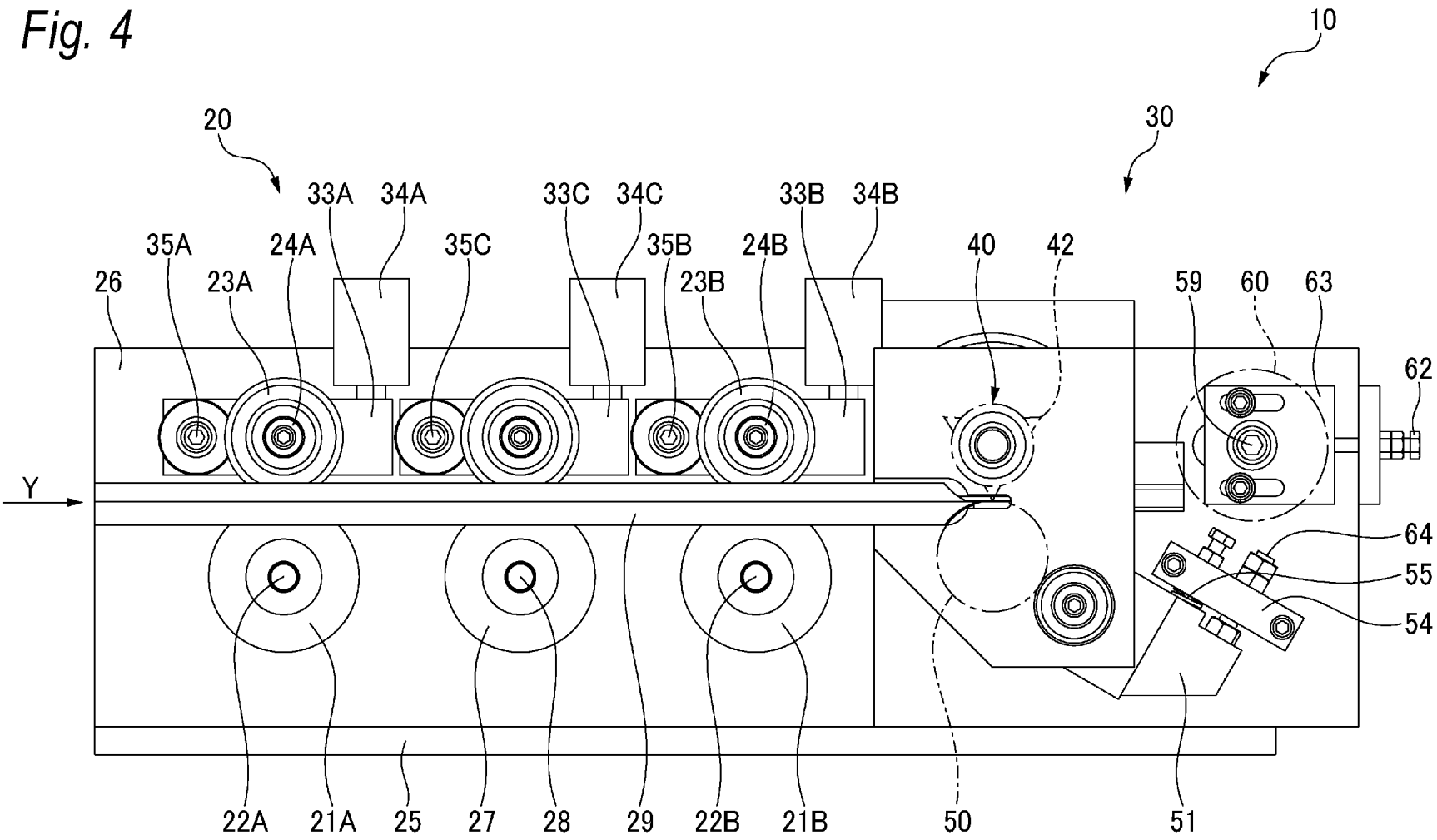
FIG. 4 is a side view of the automatic sizing cutting device.

As shown in FIGS. 3 and 4, the automatic sizing cutting device 10 includes a conveyance unit 20 for conveying the hook fastener tape T and a cutting unit 30 for cutting the hook fastener tape T at a predetermined length to form hook fastener strips FS.

The conveyance unit 20 includes a conveying guide 29 configured to allow the hook fastener tape T to pass therethrough, a pair of feed roller 21A, 21B arranged below the conveying guide 29 and also side by side along the conveying guide 29, and a pair of follower rollers 23A, 23B arranged above the conveying guide 29 and also opposing the pair of feed rollers 21A, 21B, respectively. The conveying guide 29 is constituted of two plate-shaped members extending along a conveying direction of the hook fastener tape T and opposing each other, and thus the hook fastener tape T passes therebetween in state where the plurality of longitudinal walls 81 and the plurality of transversal walls 83 of the hook fastener tape T are oriented upward. The pair of feed rollers 21A, 21B is driven by motors 31A, 31B fixed on a vertical wall 26 erected from a base 25.

Then, the hook fastener tape T supplied from the accumulation unit 5 is continuously conveyed in an arrow Y direction along the conveying guide 29 while being sandwiched between the feed rollers 21A, 21B, which are rotationally driven by the motors 31A, 31B, and the follower rollers 23A, 23B.

A measuring roller 27 between the pair of feed rollers 21A, 21B and a follower roller 23C arranged to oppose the measuring roller 27 are arranged to sandwich the hook fastener tape T therebetween and thus are rotated as the hook fastener tape T is conveyed. An encoder 32 as a measuring device is arranged on a rotation shaft 28 of the measuring roller 27, and the encoder 32 is configured to measure a conveyed length of the hook fastener tape T. A detection signal obtained by measuring the length using the encoder 32 is sent to a control device 70.

Meanwhile, supporting shafts 24A, 24B, 24C configured to respectively rotatably support the follower rollers 23A, 23B, 23C are held by holding members 33A, 33B, 33C, respectively. In addition, the holding members 33A, 33B, 33C are urged downward about shaft portions 35A, 35B, 35C by pressing members 34A, 34B, 34C, respectively, and thus the follower rollers 23A, 23B, 23C are also urged downward, i.e., toward the feed rollers 21A, 21B and the measuring roller 27.

Of the pair of feed rollers 21A, 21B, a rotation speed of the feed roller 21B arranged on a downstream side is set to be slightly faster than a rotation speed of the feed roller 21A arranged on an upstream side. Therefore, the hook fastener tape T conveyed by the pair of feed rollers 21A, 21B is conveyed while being tensioned. Alternatively, the rotation speed of the feed roller 21B arranged on the downstream side is not necessarily set to be slightly faster than the rotation speed of the feed roller 21A arranged on the upstream side. Accordingly, the rotation speed of the feed roller 21B arranged on the downstream side and the rotation speed of the feed roller 21A arranged on the upstream side may be set to be equal to each other.

Figure 5:
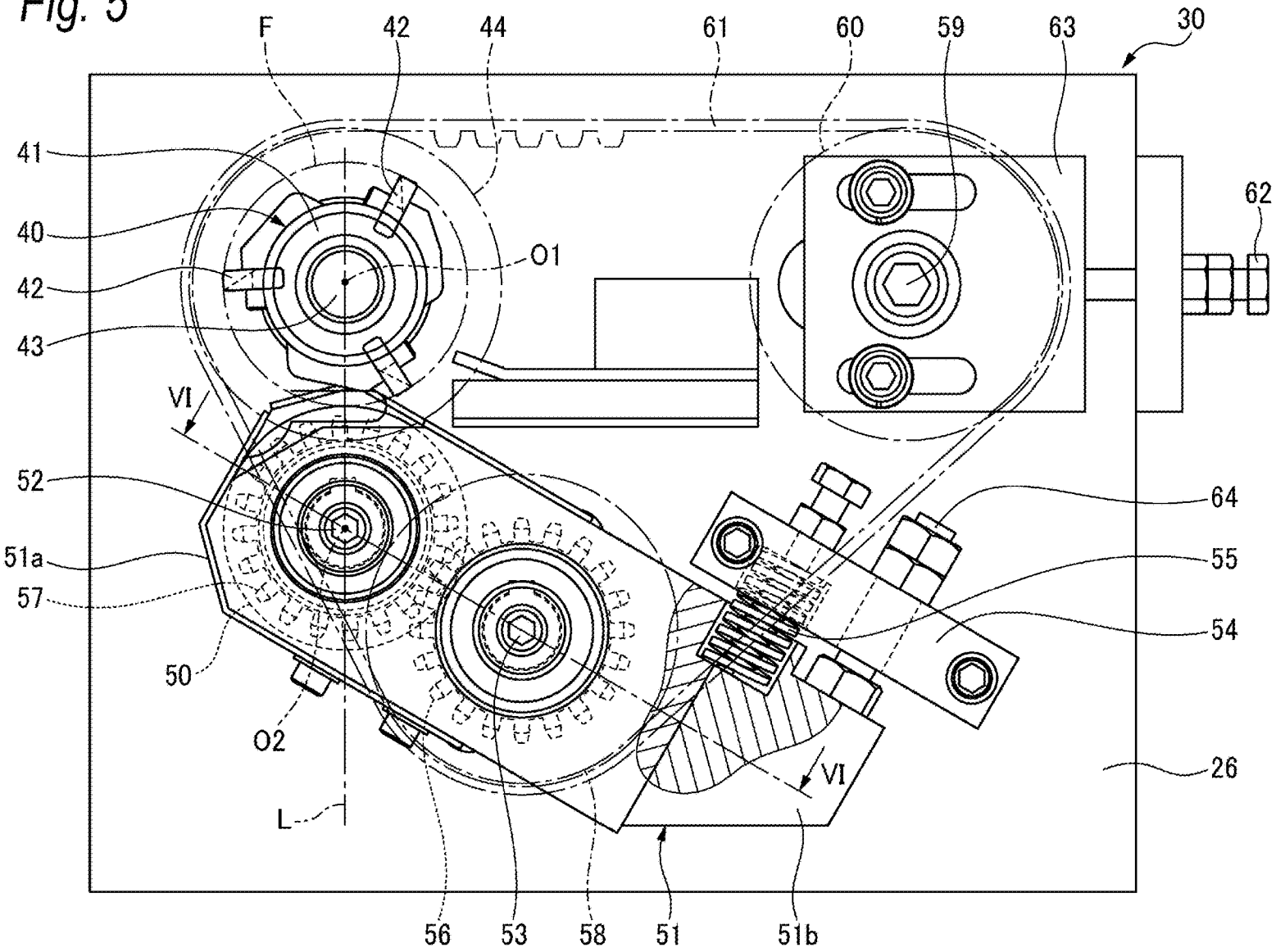
FIG. 5 is a side view of a cutting mechanism shown in FIG. 3.

Also referring to FIG. 5, the cutting unit 30 includes a rotary cutter 40 and a die roller 50 and is arranged downstream of the conveyance unit 20. The rotary cutter 40 has a generally cylindrical cutter base 41 and a plurality of cutting blades 42 (three cutting blades in FIG. 5) attached on an outer circumferential surface of the cutter base 41 to protrude radially outward therefrom.

The rotary cutter 40 is fixed on a cutter shaft 43, and the cutter shaft 43 is connected to a servomotor 45 as a driving motor fixed on the base 25 to be rotationally driven by the servomotor 45. Rotation of the servomotor 45 is controlled by the control device 70, and thus the servomotor 45 can rotate the rotary cutter 40 at an arbitrary speed, including start, stop, acceleration, deceleration and the like. Therefore, the hook fastener tape T can be cut at an arbitrary length.

Meanwhile, the plurality of cutting blades 42 is preferably provided in such a manner that an arc length (arc length on an imaginary circle F shown in FIG. 5) between distal ends of adjacent cutting blades 42 attached on the cutter base 41 is equal to a preset minimum length of the hook fastener strip FS. Therefore, in a case where the hook fastener tape T is cut into the hook fastener strips FS having the minimum length, cutting can be easily performed only by rotating the rotary cutter 40 at a constant speed. Also, in a case where the hook fastener strips FS are longer than the minimum length, it is sufficient if the rotary cutter 40 can be operated in deceleration, constant speed and acceleration states. Therefore, it is not necessary to rotate the rotary cutter 40 at a speed faster than a conveying speed of the hook fastener tape. Also, a complex rotational control of the rotary cutter 40 by the control device 70 is not required.

Further, preferably, the cutting blades 42 are provided to protrude from the cutter base 41 and also a gap dimension between the cutting blades 42 and the die roller 50 as described below is wider than a thickness dimension of the conveyed hook fastener tape T depending on a rotational position of the rotary cutter 40 (position where the cutting blades 42 are at locations other than a cutting position). By having such a configuration, it is possible to convey the hook fastener tape T without being subjected to an influence of the cutting blades 42.

Further, a pulley 44 having an outer circumferential surface formed with teeth for a timing belt is fixed on a part of the cutter shaft 43, which is located on a back surface side of the vertical wall 26.

Figure 6:
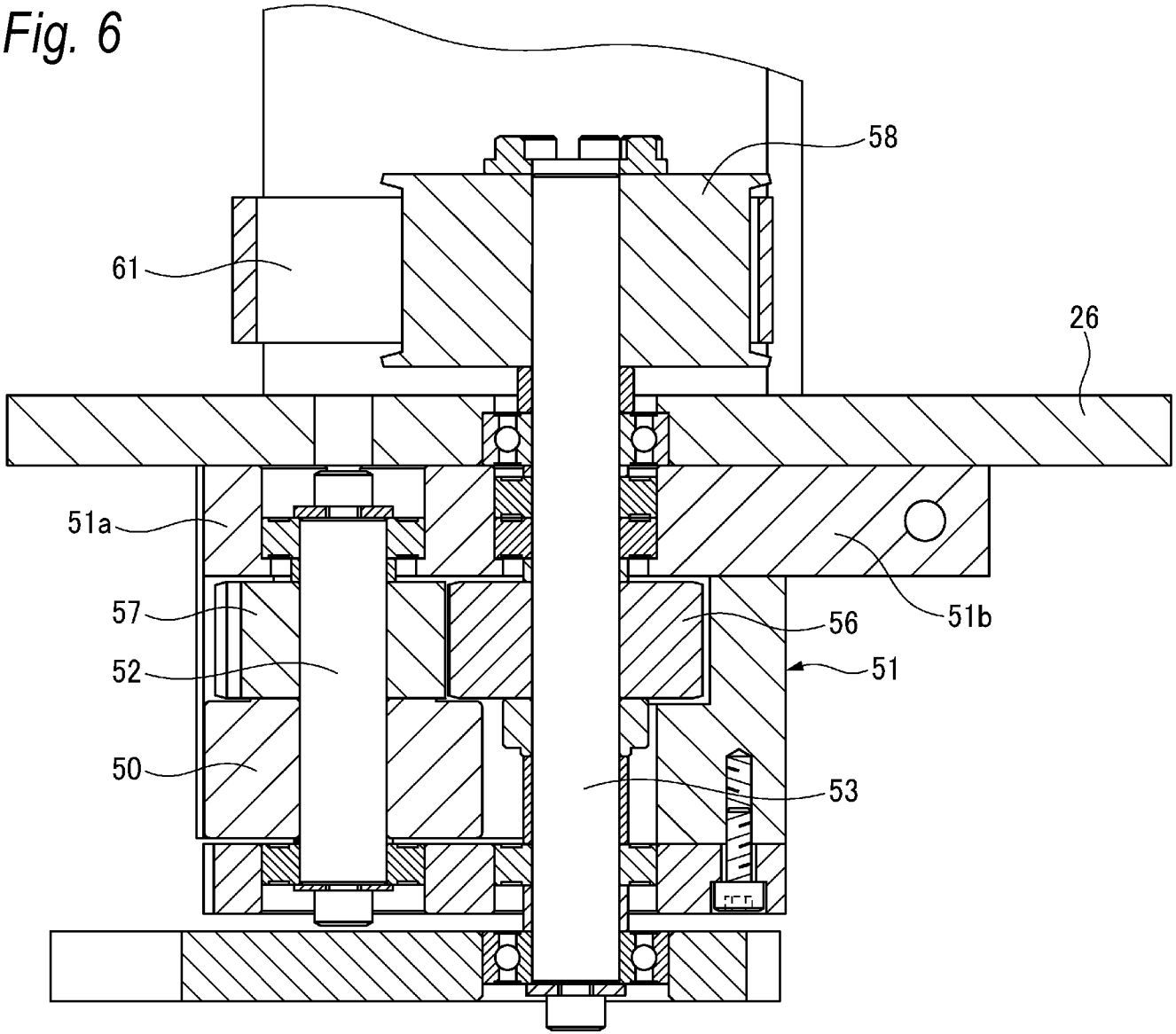
FIG. 6 is a sectional view taken along a line VI-VI in FIG. 5.

As shown in FIG. 6, the die roller 50 is a cylindrical tool rest configured to cooperate the cutting blades 42 of the rotary cutter 40 in order to cut the hook fastener tape T at a predetermined length and is arranged to oppose the rotary cutter 40. A diameter of the die roller 50 is set to be equal to a diameter of the imaginary circle F passing along distal ends of the cutting blades 42 of the rotary cutter 40.

The die roller 50 is fixed on a rotation shaft 52 fitted to one end side (free end) 51*a* of a support member 51 and thus is configured to integrally rotate with the rotation shaft 52. The support member 51 is fitted to a swing shaft 53 rotatably supported on the vertical wall 26 at the middle portion thereof and thus is swingably supported around the swing shaft 53.

A coil spring 55 as an elastic member is mounted between the other end side 51*b* of the support member 51 and a spring bearing portion 54 installed to protrude from the vertical wall 26. Therefore, the die roller 50 arranged on the one end side (free end side) 51*a* of the support member 51 is urged toward the rotary cutter 40 by an elastic force of the coil spring 55. On the spring bearing portion 54, a screw type stopper 64 is arranged to abut against the support member 51 and thus to limit a rotational position of the support member 51.

A driving gear 56 is fixed on the swing shaft 53 and is meshed with a driven gear 57 fixed on the rotation shaft 52 together with the die roller 50. The numbers of teeth of the driving gear 56 and the driven gear 57 are set to be equal to each other. Therefore, the driving gear 56 and the driven gear 57 constitutes a gear mechanism and are configured to rotate at the same rotation speed in directions opposite to each other.

Further, a pulley 58 having an outer circumferential surface formed with teeth for the timing belt is fixed on a part of the swing shaft 53, which protrudes from the vertical wall 26 toward on the back surface side thereof. The pulley 44 fixed on the cutter shaft 43 and the pulley 58 fixed on the swing shaft 53 have the same diameter. Also, the vertical wall 26 is provided with a movable base 63 adjustable in position by an adjusting screw 62. An idle pulley 60 is pivotally fitted to a stationary shaft 59 fixed on the movable base 63 and protruding toward the back surface side of the vertical wall 26.

A timing belt 61 is wound around the pulley 44, the pulley 58 and the idle pulley 60 so that a power of the servomotor 45 rotationally driving the rotary cutter 40 is transferred to the pulley 58 via the timing belt 61. Additionally, rotation of the pulley 58 in turn rotates the die roller 50 at the same speed as that of the rotary cutter 40 but in a direction opposite thereto via the driving gear 56 and the driven gear 57, which are meshed with each other. Meanwhile, a tension of the timing belt 61 is adjusted by adjusting a position of the idle pulley 60 using the adjusting screw 62.

Next, operation of the present embodiment will be described with reference to FIGS. 1, 3 and 5.

Information on the number of hook fastener strips FS required for each mold 2, which are moving on the mold assembly line 1, and a length of each of the hook fastener strips FS is inputted in the control device 70. The control device 70 operates the automatic sizing cutting device 10 so that the required hook fastener strips FS can be supplied in accordance with movement of each mold 2. Specifically, a hook fastener tape supply motor (not shown) arranged in front of the accumulation unit 5 is first driven so that the hook fastener tape T is supplied from the reel 6 to the accumulation unit 5. In the accumulation unit 5, the movable base 8 is controlled to be positioned between the upper switch SW1 and the lower switch SW2, so that a length of the hook fastener tape T wound and accumulated over the stationary pulleys 7 and the movable pulleys 9 in a zigzag fashion is maintained within a predetermined range. Also, the control device 70 controls the motors 31A, 31B and the servomotor 45 of the automatic sizing cutting device 10 so as to cut the hook fastener tape T on the basis of the information stored therein, so that hook fastener tapes FS having a length required for each mold 2 are prepared as many number as required and then supplied to the mold 2.

Next, operation of the automatic sizing cutting device 10 will be described in detail. The pair of feed rollers 21A, 21B is rotationally driven by the motors 31A, 31B, so that the hook fastener tape T sandwiched between the feed rollers 21A, 21B and the follower rollers 23A, 23B is continuously conveyed at a predetermined constant speed in the arrow Y direction. A conveyed length of the hook fastener tape T conveyed by the pair of feed rollers 21A, 21B is measured by the encoder 32, and then a detection signal thereof is sent to the control device 70.

On the other hand, the hook fastener tape T located at the encoder 32, which is a length measuring unit, is guided and conveyed by the feed roller 21B arranged on the downstream side and the feed roller 21A arranged on the upstream side. In particular, the feed roller 21A arranged on the upstream side inhibits disturbance, such as vibration of the hook fastener tape T, which occurs in the accumulation unit 5, from being transferred to the encoder 32, thereby allowing the conveyed length to be stably measured. If the rotation speed of the feed roller 21B arranged on the downstream side is set to be slightly faster than the rotation speed of the feed roller 21A arranged on the upstream side, the encoder 32 can more stably measure the conveyed length. Also, a desired conveying speed is set by the feed roller 21A arranged on the upstream side.

In addition, the control device 70 controls the servomotor 45 on the basis of the detection signal measured by the encoder 32 and also rotationally drives the cutter shaft 43. Controls of the control device 70 will be described in detail below. Rotation of the cutter shaft 43 rotates the pulley 44 together with the rotary cutter 40. Rotation of the pulley 44 is transferred to the pulley 58 via the timing belt 61, so that the driving gear 56 fixed on the swing shaft 53 is additionally rotated.

Rotation of the driving gear 56 is transferred to the driven gear 57 meshed therewith, so that the rotation shaft 52 and the die roller 50 fixed on the rotation shaft 52 are rotated in a direction opposite to a rotation direction of the rotary cutter 40. That is, the rotary cutter 40 and the die roller 50 are rotationally driven by the same servomotor 45.

Herein, since diameters of the pulleys 44, 58 are set to be equal to each other and also the numbers of teeth of the driving gear 56 and the driven gear 57 are set to be equal to each other, the rotary cutter 40 and the die roller 50 rotate at the same speed but in directions opposite to each other. Also, since the diameter of the die roller 50 and the diameter of the imaginary circle F passing along the distal ends of the cutting blades 42 of the rotary cutter 40 are set to be equal to each other, a circumferential speed of the die roller 50 on the outer circumferential surface thereof is equal to a circumferential speed of the distal ends of the cutting blades 42 of the rotary cutter 40.

In addition, the hook fastener tape T conveyed by pairs of feed rollers 21A, 21B and follower rollers 23A, 23B while being sandwiched therebetween is cut at a predetermined length by the rotary cutter 40 and the die roller 50, so that hook fastener strips FS having the predetermined length can be continually fabricated as many number as required.

Meanwhile, when the rotary cutter 40 is cutting the hook fastener tape T, the die roller 50 together with the support member 51 is pivoted about the swing shaft 53 in a counterclockwise direction in FIG. 5 against an elastic force of the coil spring 55 by a cutting resistance. However, since a position of the stopper 64 has been adjusted such that the stopper 64 abuts against the support member 51 when the distal end of the cutting blade 42 of the rotary cutter 40 and the die roller 50 come in contact with each other, it is possible to cut the hook fastener tape T without a bearing.

Further, in the rotary cutter 40 of the present embodiment, the arc length between adjacent cutting blades 42 is set to 50 mm. Therefore, in a case where the hook fastener tape T is cut at the minimum length of 50 mm equal to the arc length, the hook fastener tape T can be easily cut by continuously rotating the rotary cutter 40 at a circumferential speed equal to a conveying speed of the hook fastener tape T by the pair of feed rollers 21A, 21B.

Figure 7:
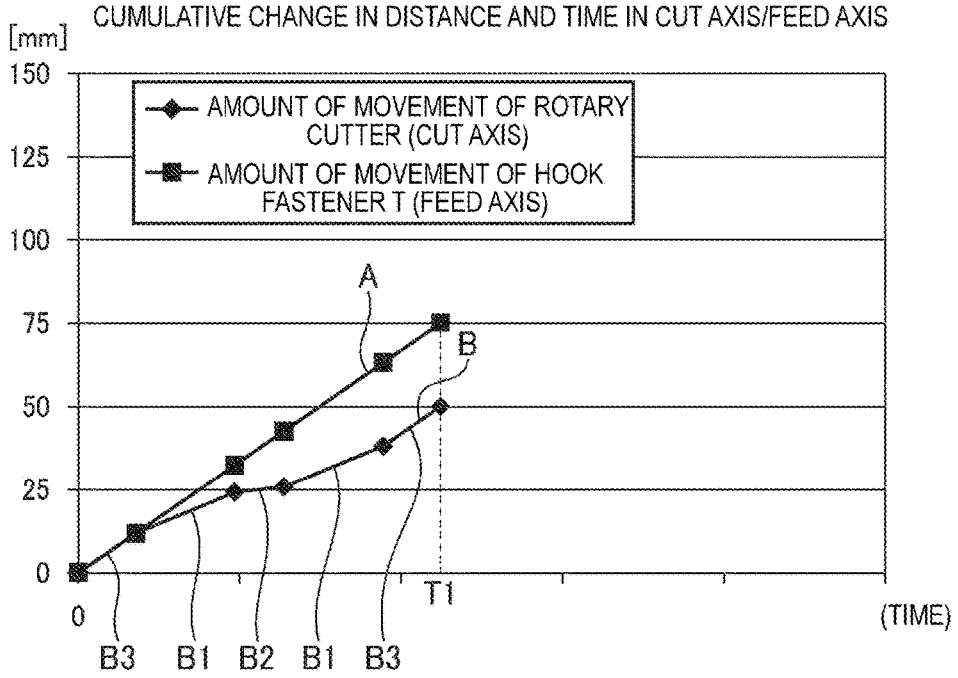
FIG. 7(*a*) is a graph showing a state where a hook fastener tape is cut at a length of 75 mm using a rotary cutter having a cutting blade interval of 50 mm, and FIG. 7(*b*) is a graph showing a state where a hook fastener tape is cut at a length of 150 mm using a rotary cutter having a cutting blade interval of 50 mm.
Figure 7:
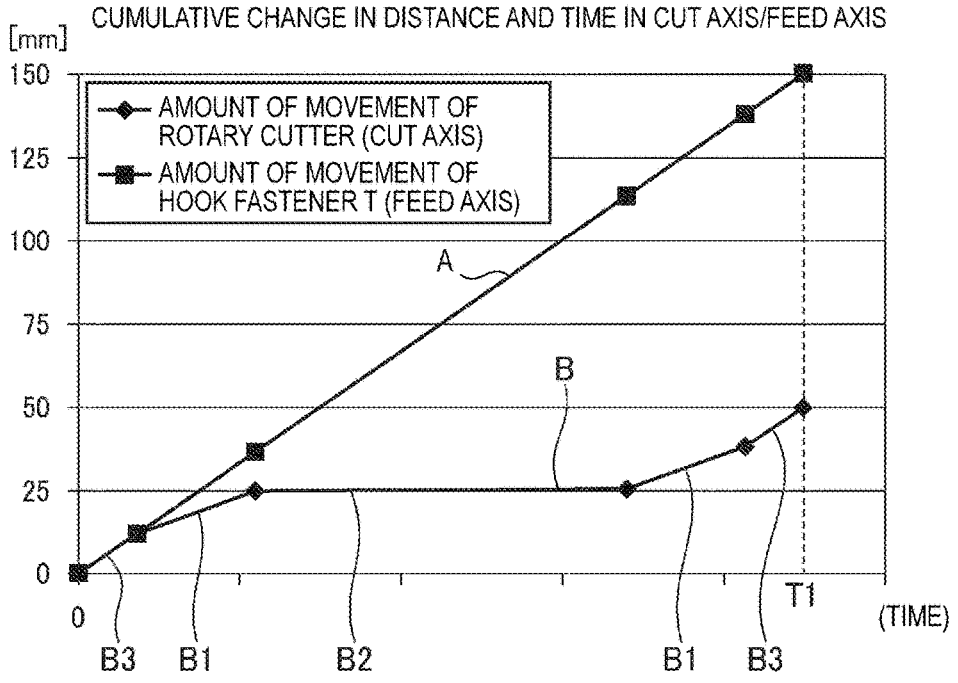

On the other hand, in a case where the hook fastener tape T is cut at a length of 75 mm, the hook fastener tape T is conveyed at a constant speed, whereas the control device 70 controls rotation of the servomotor 45 as shown in FIG. 7(*a*).

Specifically, the control device 70 controls rotation of the rotary cutter 40, i.e., the servomotor 45, in such a manner that when the hook fastener tape T has been conveyed by 75 mm on the die roller 50, the cutting blade 42 of the rotary cutter 40, as shown in FIG. 5, is positioned on a straight line L connecting the center O1 of the rotary cutter 40 with the center O2 of the die roller 50 (hereinafter, the position also referred to as a cutting position). Further, the control device 70 controls rotation of the servomotor 45 in such a manner that during a predetermined period of time before the cutting blade 40 is rotated up to the cutting position and also during a predetermined period of time after the cutting blade 42 has passed the cutting position, a circumferential speed of the cutting blade 42 is equal to the conveying speed of the hook fastener tape T.

Herein, the predetermined period of time before the cutting blade 40 is rotated up to the cutting position means at least a period of time from after the cutting blade 42 of the rotary cutter 40 has come into contact with an upper surface of the hook fastener tape T, which is being conveyed, to when the cutting blade 42 cuts the hook fastener tape T. Also, the predetermined period of time after the cutting blade 42 has passed the cutting position means a period of time from after the cutting blade 42 has cut the hook fastener tape T to when the cutting blade 42 is separated from the upper surface of the hook fastener tape T. In this way, during a period of time before the cutting blade 42 of the rotary cutter 40 cuts the hook fastener tape T after coming into contact therewith and also during a period of time before the cutting blades 42 is separated from the hook fastener tape T after cutting, the cutting blade 42 cuts the hook fastener tape T while moving at the same speed as that of the hook fastener tape T. Accordingly, extra forces other than a cutting force do not act on the hook fastener tape T, thereby allowing cutting to be performed with a good dimensional precision and also a good cut surface.

Further, since the preset cut length (75 mm) of the hook fastener tape T and the arc length (50 mm) between the cutting blades 42 of the rotary cutter 40 are different from each other, it is necessary to stop rotation of the rotary cutter 40 or to reduce the rotation speed thereof in order to make the cutting timing coincide.

Specifically, the hook fastener tape T is conveyed at a constant speed as shown by a straight line A in FIG. 7(*a*), whereas the rotation speed of each of the rotary cutter 40 and the die roller 50 is controlled on the basis of the detection signal from the encoder 32 as shown by a polygonal line B in FIG. 7(*a*). First, the circumferential speed of the cutting blades 42 of the rotary cutter 40 and the circumferential speed of the die roller 50 are controlled to become a speed B3 equal to the conveying speed of the hook fastener tape T (in FIG. 7(*a*), to have the same inclination as that of the straight line A). During this time, the cutting blade 42, which has cut off a downstream-side portion of the hook fastener tape T and thus is positioned at the lowest point, is rotated to be separated from the upper surface of the hook fastener tape T.

Thereafter, the cutting blades 42 are rotated at a speed B1 slower than the conveying speed of the hook fastener tape T and then at a speed B2 slower than the speed B1, and then again rotated at the speed B1.

Further, during a period of time before cutting, the circumferential speed of the cutting blades 42 of the rotary cutter 40 and the circumferential speed of the die roller 50 are controlled to become the speed B3 equal to the conveying speed of the hook fastener tape T (in FIG. 7(*a*), to have the same inclination as that of the straight line A). Therefore, the cutting blades 42 are controlled to be rotated by 50 mm at a cutting timing T1, at which the hook fastener tape T has been conveyed by 75 mm.

In this way, during a predetermined period of time before cutting and a predetermined period of time after cutting, a period of synchronization between the rotary cutter 40 and the hook fastener tape T (a period of the speed B3) is provided. Accordingly, cutting is performed in a state where the circumferential speed of the cutting blades 42 of the rotary cutter 40 and the circumferential speed of the die roller 50 are controlled to become a speed equal to the conveying speed of the hook fastener tape T. That is, the period of synchronization between the rotary cutter 40 and the hook fastener tape T is provided during a period of time from after the cutting blade 42 has come into contact with the upper surface of the hook fastener tape T to before the cutting blade 42 is separated from the upper surface of the hook fastener tape T after cutting. Therefore, it is possible to reduce variations in the cut length of the hook fastener tape T and also to stably cut the hook fastener tape T. Further, it is possible to obtain a good surface precision in the cut surface.

Further, in a case where the hook fastener tape T is cut at a length of 150 mm, in the same manner as described above, the hook fastener tape T is conveyed at a constant speed as shown by a straight line A, whereas, as shown by a polygonal line B, the rotary cutter 40 is rotated at a speed B1 slower than the conveying speed of the hook fastener tape T and then at a speed B2 slower than the speed B1, and then again rotated at the speed B1.

Further, a predetermined period of time before cutting and a predetermined period of time after cutting provides a period of synchronization, during which the circumferential speed of the cutting blades 42 of the rotary cutter 40 and the circumferential speed of the die roller 50 are controlled to become a speed B3 equal to the conveying speed of the hook fastener tape T. Therefore, the cutting blades 42 are controlled to be rotated by 50 mm at a cutting timing T1, at which the hook fastener tape T has been conveyed by 150 mm.

As described above, the automatic sizing cutting device 10 of the present embodiment includes a conveyance unit 20 for conveying a hook fastener tape T; an encoder 32 for measuring a conveyed length of the hook fastener tape T; a rotary cutter 40 having cutting blades 42 on an outer circumferential surface thereof and arranged downstream of the conveyance unit 20 and rotationally driven by a servomotor 45; a die roller 50 arranged to oppose the rotary cutter 40 and configured to rotate in a direction opposite to a rotation direction of the rotary cutter 40; and a coil spring 55 for urging the die roller 50 toward the rotary cutter. At least when the hook fastener tape T is cut by the cutting blades 42 of the rotary cutter 40, the hook fastener tape T is cut in a state where the rotary cutter 40 and the die roller 50 rotate at a circumferential speed equal to a conveying speed of the hook fastener tape T. Therefore, it is possible to continually cut the hook fastener tape T without stopping conveyance thereof and with a high dimensional precision, in which variations in cut length thereof is small. Further, it is possible to obtain a good surface precision in the cut surface. In particular, in the case of the hook fastener tape T having longitudinal walls and transversal walls, which are integrally molded into a foam bun, a foaming liquid enters a hook region if the surface precision is poor, thereby hindering the function of hooks. Accordingly, it is important to obtain a good cut surface.

Also, the rotary cutter 40 and the die roller 50 are driven by one servomotor 45 so as to be rotated at the same circumferential speed but in directions opposite to each other. Accordingly, it is possible to stably cut the hook fastener tape T with a good dimensional precision while continuously conveying the hook fastener tape T.

Further, the automatic sizing cutting device 10 further includes a support member 51 swingable about a swing shaft 53 and configured to be swingably urged about the swing shaft 53 by the coil spring 55; and the die roller 50 rotatably supported by the support member 51, wherein rotation of the swing shaft 53 is transferred to the die roller 50 via a driving gear 56 and a driven gear 57. Also, as the coil spring 55 urges the support member 51, the die roller 50 is urged toward the rotary cutter 40. Accordingly, it is possible to rotate the rotary cutter 40 and the die roller 50 at the same circumferential speed but in directions opposite to each other using a simple mechanism.

Further, the automatic sizing cutting device 10 further includes pairs of feed rollers 21A, 21B, which are driven by a pair of motors 31A, 31B, respectively, and follower rollers 23A, 23B configured to convey the hook fastener tape T while sandwiching the hook fastener tape T therebetween; and an encoder 32 arranged between the pair of feed rollers 21A, 21B and configured to measure a conveyed length of the hook fastener tape T. Accordingly, by controlling driving of the pair of motors 31A, 31B, the hook fastener tape T can be conveyed while being tensioned, and thus the encoder 32 can precisely measure the conveyed length of the hook fastener tape T without being influenced by disturbance factors, such as vibration. Therefore, variations in cut length of the hook fastener tape T can be inhibited.

Meanwhile, the present invention is not limited to the foregoing embodiments, but appropriate modifications, improvements and the like thereto may be made.

For example, the number of cutting blades 42 of the rotary cutter 40 is not limited to three, but may be any number.

Further, by improving resolution of the encoder 32, a dimensional precision in cut length of the hook fastener tape T can be enhanced.

REFERENCE NUMERALS LIST

10 Automatic sizing cutting device
20 Conveyance unit
21A, 21B Feed roller
23A, 23B Follower roller
27 Measuring roller
30 Cutting unit
31A, 31B Motor
32 Encoder (measuring device)
40 Rotary cutter
42 Cutting blade
45 Servomotor (driving motor)
50 Die roller
51 Support member
52 Rotation shaft
53 Swing shaft
55 Coil spring (elastic member)
56 Driving gear (gear mechanism)
57 Driven gear (gear mechanism)
FS Hook fastener strip (band-shaped piece)
T Hook fastener tape (band-shaped member)

The invention claimed is:

1. An automatic sizing cutting device for cutting a continuously supplied band-shaped member at a predetermined length to obtain a band-shaped piece, comprising:

a conveyance unit which conveys the band-shaped member;

a measuring device which measures a conveyed length of the band-shaped member conveyed by the conveyance unit;

a rotary cutter arranged downstream of the conveyance unit so as to oppose one surface of the band-shaped member and having at least one cutting blade on an outer circumferential surface thereof, the rotary cutter being rotationally driven by a driving motor;

a die roller arranged on a side of the band-shaped member opposite to the rotary cutter, and which rotates in a direction opposite to a rotation direction of the rotary cutter; and an elastic member which urges the die roller toward the rotary cutter, wherein the rotary cutter is controlled to rotate in accordance with the conveyed length of the band-shaped member measured by the measuring device, and is controlled such that circumferential speeds of the rotary cutter and the die roller at least when the cutting blade of the rotary cutter cuts the band-shaped member are equal to a conveying speed of the band-shaped member.

2. The automatic sizing cutting device according to claim 1, wherein the rotary cutter and the die roller are driven by one driving motor to be rotated at the same circumferential speed in directions opposite to each other.

3. The automatic sizing cutting device according to claim 1, further comprising:

a support member rotatably supporting the die roller, the support member configured to swing about a swing shaft and to be urged by the elastic member so as to swing about the swing shaft; and a gear mechanism arranged between a rotation shaft of the die roller and the swing shaft, wherein the swing shaft is rotated by the driving motor, the die roller is rotated as rotation of the swing shaft is transferred thereto via the gear mechanism, and the die roller is urged toward the rotary cutter as the elastic member urges the support member.

4. The automatic sizing cutting device according to claim 3, wherein the driving motor is connected to a cutter shaft of the rotary cutter, and a power of the driving motor is transferred to the swing shaft via a timing belt spanned over pulleys respectively fixed on the cutter shaft and the swing shaft.

5. The automatic sizing cutting device according to claim 1, wherein the conveyance unit includes a pair of feed rollers driven by a pair of motors respectively, and a pair of follower rollers arranged to oppose the pair of feed rollers respectively, and which conveys the band-shaped member while sandwiching the band-shaped member between the feed rollers and the follower rollers, the measuring device is arranged between the pair of feed rollers, and rotation speeds of the pair of feed rollers are set such that a rotation speed of the feed roller arranged on a downstream side is faster than a rotation speed of the feed roller arranged on an upstream side, so as to convey the band-shaped member while applying a tension to the band-shaped member.

* * * * *